US010017916B2

(12) United States Patent
Anderson

(10) Patent No.: US 10,017,916 B2
(45) Date of Patent: Jul. 10, 2018

(54) EARTH WORKING APPARATUS

(71) Applicant: Duncan Anderson, Immingham (GB)

(72) Inventor: Duncan Anderson, Immingham (GB)

( * ) Notice: Subject to any disclaimer, the term of this patent is extended or adjusted under 35 U.S.C. 154(b) by 0 days.

(21) Appl. No.: 15/111,561

(22) PCT Filed: Jan. 14, 2015

(86) PCT No.: PCT/GB2015/050063

§ 371 (c)(1),
(2) Date: Jul. 14, 2016

(87) PCT Pub. No.: WO2015/107337

PCT Pub. Date: Jul. 23, 2015

(65) Prior Publication Data

US 2016/0333548 A1 Nov. 17, 2016

(30) Foreign Application Priority Data

Jan. 14, 2014 (GB) ..... 1400600.1

(51) Int. Cl.

| | |
|---|---|
| ***E02F 5/08*** | (2006.01) |
| ***E02F 5/02*** | (2006.01) |
| ***E02F 5/10*** | (2006.01) |
| ***E02F 5/12*** | (2006.01) |
| ***E02F 7/02*** | (2006.01) |
| ***E02F 7/06*** | (2006.01) |

(Continued)

(52) U.S. Cl.

CPC ..... *E02F 5/08* (2013.01); *E02F 3/181* (2013.01); *E02F 3/188* (2013.01); *E02F 3/967* (2013.01); *E02F 5/022* (2013.01); *E02F 5/10* (2013.01); *E02F 5/12* (2013.01); *E02F 7/02* (2013.01); *E02F 7/06* (2013.01)

(58) Field of Classification Search

CPC ..... E02F 5/08; E02F 5/10; E02F 5/12

See application file for complete search history.

(56) References Cited

U.S. PATENT DOCUMENTS 2,533,793 A 12/1950 Hamlett
3,664,142 A * 5/1972 Jansz ..... E02F 5/104 405/163

(Continued)

FOREIGN PATENT DOCUMENTS

SU 19256 A1 2/1931
SU 956695 A1 9/1982

(Continued)

OTHER PUBLICATIONS

GB Search Report of Patent Application No. GB1400600.1 filed Jan. 14, 2014, dated Jul. 10, 2014.

(Continued)

*Primary Examiner* — Tara Leigh Mayo-Pinnock

(74) *Attorney, Agent, or Firm* — Maine Cernota & Rardin

(57) ABSTRACT

An earth working apparatus, for laying a pipe or cable underground. The earth working apparatus comprises a plurality of trenching modules. Each trenching module is arranged sequentially in a first plane and comprises a cutter in communication with a conveyor. In a second aspect, each trenching module cuts a layer of earth and conveys said layer of earth to a collection device or to a collection area.

20 Claims, 2 Drawing Sheets

(51) Int. Cl.
*E02F 3/18* (2006.01)
*E02F 3/96* (2006.01)

(56) References Cited

U.S. PATENT DOCUMENTS

| | | | | |
|---|---|---|---|---|
| 4,023,288 | A * | 5/1977 | Roe | E02D 3/032 172/464 |
| 4,028,902 | A | 6/1977 | Courson et al. | |
| 4,958,457 | A * | 9/1990 | Doskocil | E02F 3/188 172/112 |
| 5,120,433 | A | 6/1992 | Osadchuk | |
| 5,379,534 | A | 1/1995 | Negishi | |
| 6,854,931 | B1 | 2/2005 | Lopata | |

FOREIGN PATENT DOCUMENTS

| | | | |
|---|---|---|---|
| WO | 200233180 | A1 | 4/2002 |
| WO | 2004055276 | A1 | 7/2004 |

OTHER PUBLICATIONS

International Search report and Written Opinion of Application No. PCT/GB2015/050063 filed Jan. 14, 2015, dated Apr. 9, 2015.

* cited by examiner

EARTH WORKING APPARATUS

RELATED APPLICATIONS

This application is a National Phase application filed under 35 USC § 371 of PCT Application No. PCT/GB2015/050063 with an International filing date of 14 Jan. 2015, which claims priority to GB Patent Application 1400600.1, which was filed on 14 Jan. 2014. Each of these applications is herein incorporated by reference in their entirety for all purposes.

FIELD OF THE INVENTION

The present invention relates to earth working apparatus, in particular earth working apparatus which are suitable for laying a pipe or cable underground.

BACKGROUND TO THE INVENTION

Conventional earth working devices include such machines as first planers, diggers, trenchers or borers. In order to lay a pipe or cable underground engineers most commonly dig a trench, remove the earth to a temporary location, lay the pipe or cable in the trench and then back fill the trench with the earth from the temporary location. Conventional trench cutters use the same components to cut the trench as to remove the earth from the trench. Furthermore the trench cutting is performed in one pass to the full depth of the trench. Optionally the pipe or cable is laid simultaneously with the cutting procedure. This requires relatively substantial machines even for the smallest trenches. A second machine is then required to fill the earth back into the trench over the inserted pipe or cable. Invariably this means that the earth constituents of the trench are required to be stored somewhere or transported away and in most cases mixed up. Therefore one is left with a line of subsoil on the surface which looks unsightly and is difficult to manage.

A previous attempt to provide a solution to this problem is described in SU19256. SU19256 describes a cable laying machine consisting of several tiers of inclined cutting blades for breaking up and loosening the soil, of belt conveyors for transporting it rearwards, and of includes surfaces for lowering the soil back into the trench, the cable being simultaneously unwound and laid below the middle part of the machine.

There has now been devised an earth working apparatus which overcomes or substantially mitigates the above-mentioned and/or disadvantages associated with the prior art.

SUMMARY OF THE INVENTION

In a first aspect of the invention there is provided an earth working apparatus for laying a pipe or cable underground, comprising a plurality of trenching modules, each trenching module being arranged on top of one another in a first plane and comprising a cutter in communication with a conveyor, wherein, in use, the speed of the lowermost conveyor is the same as the forward speed of the apparatus and the speed of each remaining conveyor increases progressively towards the surface in proportion to the length of each remaining conveyor.

The apparatus according to the invention is advantageous because different components cut the trench as those which remove the earth from the trench. This reduces the overall wear on the apparatus and allows replacement of individual parts rather than complete trenching components which conventionally cut the whole trench as well as removing the spoil. Furthermore, by introducing a plurality of trenching modules the amount of earth cut by each module whilst still cutting a trench is significantly reduced. Furthermore, in use (ie when the apparatus is moving forward through the earth) each trenching module cuts a layer of earth and replaces said layer of earth in the same place from where it was cut. That is to say, the subsoil layers remain as subsoil layers after cutting and the top soil layers remain on the top surface etc after cutting, without significant mixing of each of the layers. Thus the structure of the earth is maintained. Not only that, but it also means that the spoil is also returned to the same place in relation to the direction of travel. This also makes backfilling of the trench an efficient process and one that is less likely to damage whatever pipes or cables are placed into the trench.

Earth working apparatus comprises any device which is capable of at least cutting earth. Preferably the earth working apparatus according to the invention cuts and manipulates earth. Earth may include stone, rock, bedrock, old foundations, brick, rubble, hardcore, asphalt, bitumen, soil, subsoil, sub-base, sand, loam, clay, silt or mud, concrete, tarmac, or other road/pavement components.

A pipe according to the invention comprises any tubular object adapted for conveyance of solid, liquid or gas. Examples of pipes include, but are not limited to drainage pipes, metal pipes for carrying gas, or plastic pipes for carrying cables.

A cable according to the invention comprises anything capable of forming a strand. Examples of cables include, but are not limited to, tape, string, wires, ropes or fibre optics.

Underground according to the invention preferably refers to underneath the top surface of the ground upon which the apparatus is working. It will be appreciated that the apparatus is further suitable for laying pipe or cable in the region of the top surface of the ground, and therefore underground may include within the region of the top surface of the ground.

The cutter according to the invention can be any device which is capable of breaking into and particulating the earth.

In a second aspect of the invention there is provided an earth working apparatus for laying a pipe or cable underground, comprising a plurality of trenching modules, each trenching module being arranged on top of one another in a first plane and comprising a cutter in communication with a conveyor, wherein, each cutter comprises one or more cutting surfaces which are rotatable 360 degrees around a central axis of the cutter.

This means that the cutting surfaces can cut efficiently into the earth and the speed of the cutters can be altered independently of the forward speed of the apparatus. For example, the cutters can cut whilst the apparatus is not moving forward through the earth. It also makes manipulating the apparatus within the earth more efficient, as forward motion is not required to cut.

Examples of suitable cutters include, but are not limited to flail cutters, rotary cutters, first planer cutters, saw cutters, fixed pick cutters or grinder cutters. Preferably the cutter comprises a series of teeth. This improves the cutting action. Each cutter within the plurality of trenching modules may have different overall shapes and dimensions. For example the cutters closest to the surface may be wider than those that are deepest. This enables the apparatus to work the earth differently, for example to produce a trench with battered sides. Preferably the cutters are powered individually.

The conveyor can be any device which transports earth away from the cutting surfaces of the cutter. The conveyor may be part of the cutter. The conveyor may be attached to or in the region of the part of the cutter where the earth is deposited during the cutting process. The conveyor may be a pipe or slide to allow earth to travel through it or on it, respectively. The pipe may be a tube tilted substantially from the horizontal so that earth entering it falls through the pipe under the effect of gravity. The slide may be a ramp, half-pipe or arcuate structure, tilted substantially from the horizontal so that earth on it falls down the slide under the effect of gravity. The conveyor may also be a rotational type conveyer. The conveyor may be an auger, spiral or screw or the like. Preferably the auger, spiral, screw or the like are encased within a housing in order to control the distance the earth is conveyed. The conveyer may also be a longitudinal type conveyor. The conveyor may be a belt or track conveyor. Other examples of suitable conveyors include, but are not limited to wire mesh conveyors, bucket conveyors, flexible conveyors, spiral conveyors, vibrating conveyors, pneumatic conveyors, belt driven live roller conveyors, line-shaft roller conveyors, chain conveyors, chain driven live roller conveyors or dust proof conveyors.

A layer of earth according to the invention can be any stratum of earth. The amount of earth cut to form said layer is preferably defined by the dimensions and design of the cutter. The amount of earth cut to form said layer may also be defined by the movement of the cutter within the soil.

The plurality of trenching modules according to the invention are arranged in a first plane. The first plane is preferably a vertical first plane. The first plane is preferably defined by the direction of travel of the apparatus when the apparatus is in use, that is to say, when one or more cutters are in contact with and moving through the earth. One or more of the trenching modules of the plurality of trenching modules may be pivotal about the first plane. One or more of the trenching modules of the plurality of trenching modules may be pivotal about a second plane running perpendicularly to the first plane. In use the apparatus moves through the soil and preferably each trenching module moves in the same direction. The first plane may therefore be oblique to the vertical. This means that the trench dug by the apparatus has a central axis which is oblique to the vertical also. One or more trenching modules in the plurality of trenching modules may be offset from the first plane. This also means that the trench dug by the apparatus can be oblique to the vertical. One or more of the trenching modules within the plurality of trenching modules may be pivoted away from the direction of travel of the apparatus in use. This all means that the apparatus can cut in different directions laterally (ie around corners). It also means that the apparatus can be angled into the soil to dig deeper, or lifted out conversely. For example when the apparatus is required to take into account undulations in the path of travel. It also means that different shaped trenches can be dug. One or more of the trenching modules may be activated or deactivated with respect to the plurality of trenching modules.

Each cutter is preferably arranged within the first plane. Each cutter may be displaced on top of or below its nearest neighbour cutter. Each cutter may be staggered vertically and horizontally with respect to neighbouring cutters, but within the same first plane. This means that complete layers of earth are cut. There may be a gap in the horizontal direction between one cutter and its neighbours. Different types of cutter as described above may be implemented for different modules. When the cutters comprise one or more cutting surfaces which rotate 360 degrees around a central axis of the cutter, the speed of rotation of each cutter may be different. Thus, the speed of rotation of the cutters closest to the surface may be slower than the speed of the cutters that are deeper into the earth. This may prevent wear on the apparatus, or allow the operator to produce different sized particulate matter for each layer. The speed of the cutters relative to the conveyors and vice versa, may be altered. This means that different sized particulate matter can be worked at different layer depths. The central axis of the cutter may be within the first plane. The central axis of the cutter may be in the horizontal during use. Preferably the central axis of the cutter is perpendicular to the first plane.

Each conveyor is preferably arranged within said first plane. Each conveyor may be displaced on top of or below its nearest neighbour conveyor within the first plane. The lowermost conveyor is preferably flat and the remaining conveyors preferably comprise angled and/or inclined portions. This means that the earth is transported along the conveyors in different directions. This also means that the earth on one conveyor is effectively transported up and over the conveyor below. It will be appreciated that the lowermost conveyor may also comprise may comprise angled and/or inclined portions. In this instance it is clear that the distance the earth travels is increased. Therefore in order that the earth is transported to the same place it was cut, the speed of the lowermost conveyor must be increased. As such, instead of the speed of the lowermost conveyor being the same as the forward speed of the apparatus, the speed of the lowermost conveyor may be a multiple greater than 1 of the forward speed of the apparatus. The multiple maybe whole or fractions of numbers. The extent of the multiple may be predetermined by calculation if the forward speed of the apparatus is constant. If the forward speed is variable then the speed of the lowermost conveyor may be controlled manually or automatically by the user of the apparatus. Such manual control may be to increase or decrease the power to the motors driving the conveyor. Automatic control may be by a computer interfaced to the motors. Different types of conveyor as described above may be implemented for different modules.

The end of each conveyor (i.e. the end not in communication with the cutter) is preferably arranged within the first plane. Each end is staggered vertically and horizontally with respect to neighbouring ends, but within the same first plane. The staggering means that earth deposited from each end does not interfere or mix with earth deposited from neighbouring ends. The apparatus according to the invention therefore deposits separate layers of earth starting from the lowermost part of a trench up to the uppermost part of said trench.

Any of the ends of the conveyors may be in communication with one or more refill chutes and/or compactors.

Each trenching module may be independently operable from one another. Each conveyor may be independently operable from one another. Each cutter may be independently operable from one another. That is to say for example, the cutters can be controlled individually or all can be tilted in line with the path of travel to account for undulations in the path. Similarly all may be raised or lowered with respect to one another. Similarly all may be tilted or angled perpendicularly with the path of travel to allow for slope perpendicular to travel. Similarly all may be slewed (front in, back out and vice versa) to make travel around bends easier.

In order to provide the independent features described above, the apparatus preferably further comprises a framework to support the trenching modules, conveyors and cutters. Each individual trenching module, conveyor and cutter is preferably pivoted on said framework. The framework comprises a series of electric and/or hydraulic motors to power the trenching modules, conveyors and cutters. Each motor can be operated independently of one another. This means that each cutter and conveyor and module can be turned on and off, moved, pivoted or the speed altered with respect to its neighbour or the overall apparatus.

In a third aspect of the invention there is provided an earth working apparatus for laying a pipe or cable underground, comprising a plurality of trenching modules, each trenching module arranged in a first plane and comprising a cutter in communication with a conveyor, wherein in use each trenching module cuts a layer of earth and conveys said layer of earth to a collection device or to a collection area.

The apparatus according to the second aspect of the invention is advantageous because the apparatus is working continuously with a 100% working cycle. This is to say, the earth can be transported away while the apparatus continues to work. It also enables the layers of earth to be kept separate, such that they can be returned to the trench in the same order that were cut, but at a later time.

The collection device may be a conveyor or container lorry or other means for collecting the worked earth. The collection area may be an area of land apportioned for collection of the worked earth. In the second aspect of the invention any of the ends of the conveyors may be in communication with one or more hoppers, collectors or conveyors. Said hoppers, collectors or conveyors may be used to transport the worked earth away from the apparatus.

Pipe or cable may be laid underground during the working of the earth by the earth working apparatus. The apparatus may therefore comprise means for supplying pipe or cable from a source to the region behind the cutters after the apparatus has started to move through the earth. The cable or pipe may be laid underground at any of the levels described above. The pipe or cable may be left uncovered in the area of earth of that has been worked (i.e. the trench). The cable or pipe may be provided by a separate machine but integrated into the trench by the apparatus according to the invention.

The apparatus may be self-propelled or adapted to be fitted to a vehicle. Said vehicle preferably provides a platform for the apparatus to operate from and also provides means for transporting the apparatus or working under water. Examples of suitable vehicles include, but are not limited to, tracked vehicles, railway vehicles, road vehicles, boats, barges etc. When the apparatus is self-propelled it may be driven to the site, or towed by a separate vehicle and then disengaged from the towing vehicle to begin operation.

In a third aspect of the invention there is provided a vehicle comprising an earth working apparatus according to the first or second aspects of the invention as described above.

A preferred embodiment of the invention will now be described in greater details by way of illustration with reference to the accompanying drawings.

DETAILED DESCRIPTION OF THE ILLUSTRATED EMBODIMENT

Figure 1:
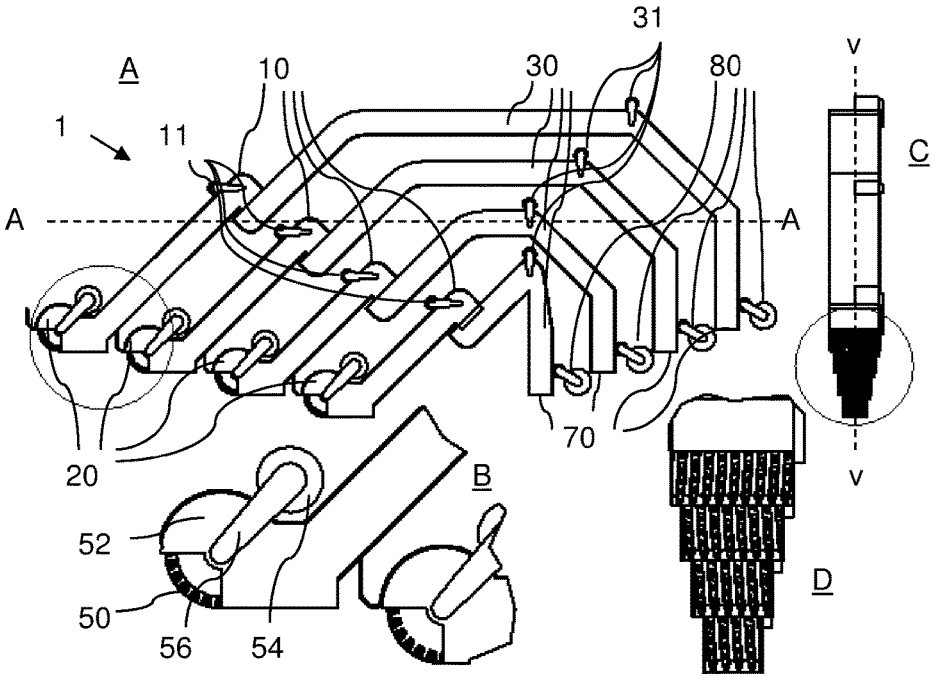
FIG. 1 shows a schematic side view of an embodiment of an apparatus according to the invention.

FIG. 1A shows a side view of the apparatus generally designated 1. The apparatus 1 comprises a plurality of trenching modules 10 each containing a material conveying device driven by a motor and drive system 11.

Each trenching module 10 is arranged sequentially about a substantially vertical first plane and comprises a cutter 20, with each cutter 20 in communication with a conveyor 30. FIG. 1B is a detailed representation of the area marked on FIG. 1A and shows a close up of the cutter 20. Looking through line A-A on FIG. 1A one would see what is represented in FIG. 1C. FIG. 1C shows the vertical first plane V-V referred to above. FIG. 1D shows a close up of the highlighted region of FIG. 1C and provides detail of the cutting parts of the cutters 20. The cutter 20 has cutting edges 50 (FIG. 1B). The cutter 20 is a rotary first planer type cutter and is surrounded by a housing 52. The cutter 20 is driven by a motor 54 via a drive system 56. The conveyors 30 are all belt conveyors enclosed within a housing. Each conveyor 30 is driven by a motor 31. The conveyors 30 are each in a number of portions and are positioned on top of one another in a vertical first plane (V-V in FIG. 1C). At the ends of each conveyor 30 (i.e. those ends not with the cutters on) there is a chute 70 and a compactor 80. As can be seen in FIG. 1D each cutter is arranged so that its diameter overlaps its nearest neighbour. This presents a continuous cutting surface throughout the whole depth of the trench. Therefore looking along line A-A in FIG. 1A the cutters each cut a layer of earth to collectively make up a trench. The width of each cutter 20 is also different so that in this embodiment a tapered trench is worked.

Figure 2:
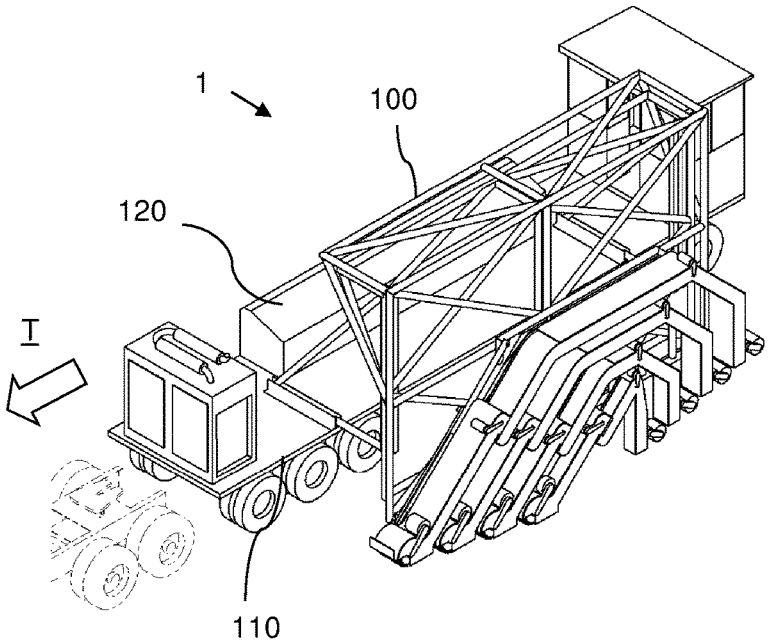
FIG. 2 shows a three dimensional view of an embodiment of an apparatus according to the invention wherein the apparatus is mounted on a lorry.

In use, the trenching modules 10 are each mounted on a frame 100 shown in FIG. 2. The frame 100 is fitted to a working/operating platform such as a lorry 110. The frame 100 is capable of being rotated using hydraulics (not shown) in order to raise and lower the trenching modules 10. In alternative embodiments, the frame 100 is rotated using electric motors driving a rack and pinion type device or other drive mechanism. In the embodiment shown in FIG. 2 the trenching modules 10 are lowered into a position which is parallel with the direction of travel (T) of the lorry but offset from the line of travel. Such an embodiment is particularly useful for digging trenches and laying pipe or cable very close to an obstruction such as a wall. It will be appreciated however that the trenching modules 10 do not need to be offset and a vehicle could be used which carries the modules in its body along the line of travel. The frame 100 is made of steel and is counterbalanced by a weight 120. Power for the trenching modules 10 is provided by hydraulic motors and electric motors and driven from the lorry 110. Each of the trenching modules 10 is operable independently and can be lowered and angled at varying different angles, depths and inclinations. In use, the trenching modules 10 are lowered as shown and the lorry 110 is driven in direction "T". The trenching modules 10 are operated and earth is cut in layers by the cutters 20 as the apparatus moves forward. Each of the layers of earth then travels along the respective conveyor 30 and is deposited at the rear via the chutes 70 in the same orientation as they were cut. After cutting and before deposition of the earth, cable is laid in the bottom of the trench. The lorry 110 provides a source for the cable. In an alternative embodiment the cable is laid from an independent vehicle. In this way each trenching module cuts a layer of earth and replaces said layer of earth in substantially the same location from where it was cut with respect to neighbouring layers.

Figure 3:
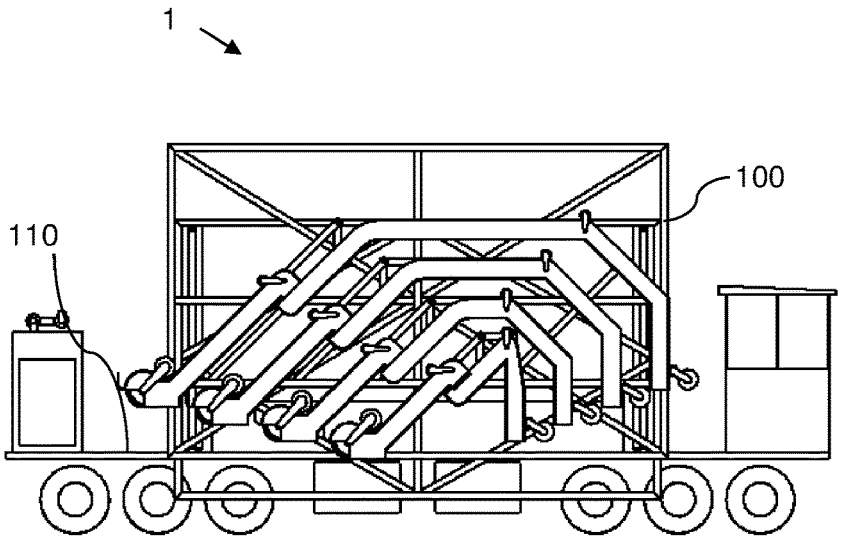
FIG. 3 shows schematic view of an embodiment of an apparatus according to the invention wherein the apparatus is mounted on a lorry and is retained in its transport position.

After the operation has been completed or when transport is required the trenching modules 10 are raised using the frame 100 so as to be placed within the confines of the lorry 110 (see FIG. 3).

Figure 4:
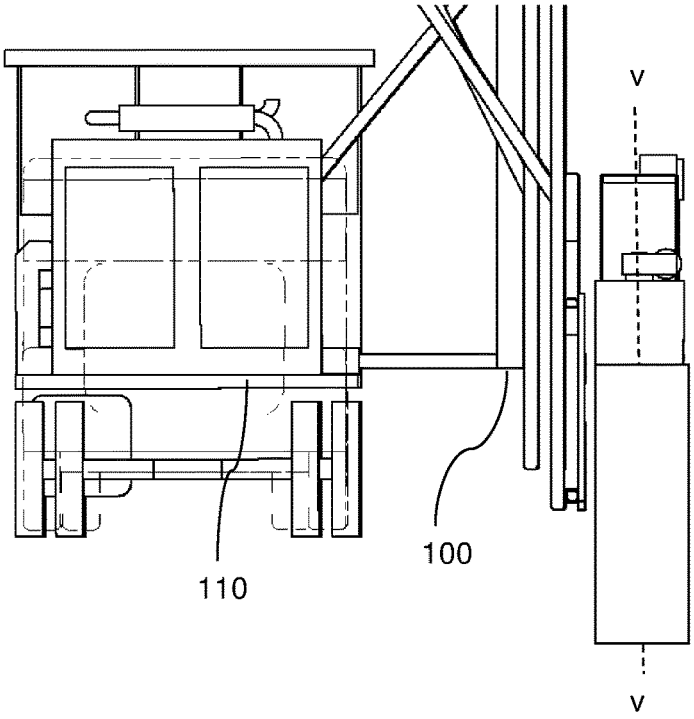
FIG. 4 shows schematic frontal view of an embodiment of an apparatus according to the invention wherein the apparatus is mounted on a lorry.

FIG. 4 shows the vertical first plane v-v of the invention (running into and out of the page). The trenching modules 10 are mounted on a frame 100 on a lorry 110. When the trenching operation is offset as shown in FIG. 4, the apparatus can either work very close to an object or the trenching does not interfere with the surface where the wheels of the device carrying the apparatus are traveling, for example a railway track or narrow country lane. Consequently, control of slew and tilt is required. This is achieved using the counterbalance weight 120 (shown in FIG. 2). However, in use, the apparatus cuts a trench, lays a cable or pipe into said trench, the earth is replaced and all these main tasks completed in one operation.

The invention claimed is:

1. An earth working apparatus for laying a pipe or cable underground, comprising:

a plurality of trenching modules, each trenching module comprising:

a housing encapsulating a conveyor;

a motor and drive system fixed to said housing; and a plurality of rotary road planer cutters partially contained within said housing and in operative communication with said motor through said drive system, wherein each said cutter is in communication with a conveyor, wherein said plurality of trenching modules are arranged on top of one another in a first plane, wherein, each cutter further comprises one or more cutting surfaces which are rotatable 360 degrees around a central axis of the cutter and configured to cut earth when in use, wherein each said housing, motor, and drive system, during use, occupies a strata cut by a cutter of an adjacent trenching module, and wherein the speed of the cutters relative to the conveyors and vice versa is adjustable.

2. The earth working apparatus according to claim 1, wherein each said conveyor is attached to or in the region of the part of the one of said cutters where the earth is deposited during the cutting process.

3. The earth working apparatus according to claim 1, wherein the first plane is a vertical first plane.

4. The earth working apparatus according to claim 1, wherein the first plane is defined by the direction of travel of the apparatus, in use.

5. The earth working apparatus according to claim 1, wherein one or more of the trenching modules of the plurality of trenching modules are pivotal about the first plane.

6. The earth working apparatus according to claim 1, wherein one or more of the trenching modules of the plurality of trenching modules are pivotal about a second plane running perpendicularly to the first plane.

7. The earth working apparatus according to claim 6 wherein one or more of the trenching modules may be pivoted away from the direction of travel in use.

8. The earth working apparatus according to claim 1, wherein one or more of the trenching modules within the plurality of trenching modules are pivoted away from the direction of travel of the apparatus in use.

9. The earth working apparatus according to claim 1, wherein one or more of the trenching modules are activated or deactivated with respect to the plurality of trenching modules.

10. The earth working apparatus according to claim 1, wherein each cutter is displaced on top of or below its nearest neighbor cutter.

11. The earth working apparatus according to claim 1, wherein each cutter is staggered horizontally with respect to neighboring cutters, but within the first plane.

12. The earth working apparatus according to claim 1, wherein the central axis of each cutter is within the first plane.

13. The earth working apparatus according to claim 1, wherein any of the ends of the conveyors are in communication with one or more refill chutes and/or compactors.

14. The earth working apparatus according to claim 1, wherein each trenching module is independently operable.

15. The earth working apparatus according to claim 1, wherein each conveyor is independently operable.

16. The earth working apparatus according to claim 1, wherein each cutter is independently operable.

17. The earth working apparatus according to claim 1, wherein the apparatus further comprises a framework to support the trenching modules, conveyors and cutters.

18. The earth working apparatus according to claim 17, wherein each individual trenching module, conveyor and cutter is pivoted on said framework.

19. The earth working apparatus according to claim 1, wherein the apparatus is configured to deposit and bury pipe or cable in a trench created thereby during the operation thereof.

20. The earth working apparatus according to claim 19, wherein said pipe or cable is supplied by a vehicle independent from said earth working apparatus.

* * * * *